United States Patent [19]

Carnaby

[11] Patent Number: 4,502,403

[45] Date of Patent: Mar. 5, 1985

[54] TUFTING MACHINE NEEDLES

[75] Inventor: Garth A. Carnaby, Papanui, New Zealand

[73] Assignee: Wool Research Organization of New Zealand (Inc.), Canterbury, New Zealand

[21] Appl. No.: 518,841

[22] Filed: Aug. 1, 1983

[30] Foreign Application Priority Data

Aug. 2, 1982 [NZ] New Zealand ..... 201452

[51] Int. Cl.[3] ..... D05C 15/20

[52] U.S. Cl. ..... 112/222

[58] Field of Search ..... 112/222, 79 R

[56] References Cited

U.S. PATENT DOCUMENTS 3,469,548 9/1969 Zocher ..... 112/222
3,929,082 12/1975 Zocher ..... 112/222
3,954,072 5/1976 Zocher ..... 112/222
4,233,917 11/1980 Carnaby ..... 112/222

*Primary Examiner*—Ronald Feldbaum
*Attorney, Agent, or Firm*—Watson, Cole, Grindle & Watson

[57] ABSTRACT

A needle for tufting, sewing, stitching the like machines, the needle including a shaped elongate blade having at one end thereof a shank and at the other end thereof a point to which is positioned a needle eye, the elongate blade having a shaped longitudinal input recess in one side of the blade above the eye, the input recess having a sloped floor region immediately above the eye which is in the same plane as any bias on the shank of the needle and wherein the angle of the floor relative to the sides of the needle eye is outside the range of 85°-95° degrees.

9 Claims, 6 Drawing Figures

TUFTING MACHINE NEEDLES

FIELD OF THE INVENTION

This invention relates to needles of the type used on tufting, sewing, stitching and the like machines.

DESCRIPTION OF THE PRIOR ART

The needles currently used on tufting, sewing, stitching and the like machines often cause machine stoppages when yarn joints, knots, lumps, yarn irregularities, and impurities such as vegetable matter jam in the needle eye and cause the yarn to break.

In an attempt to overcome these disadvantages the applicants designed a needle which is commonly referred to in the market as WRONZ standard needle. The WRONZ standard needle is described and claimed in U.S. Pat. No. 4,233,917 (Carnaby). The needle described in U.S. Pat. No. 4,233,917 (Carnaby) comprises a shaped elongate blade having at one end thereof a shank and at the other end thereof a point adjacent to which is positioned a needle eye, the elongate blade and the point having a shaped path formed therein above the needle eye and on the point, the path being defined a longitudinal recess located in one side of the blade above the eye and cut-away portion on a side of a region of the point opposite said one side on which the longitudinal recess is located, the path allowing substantially unimpeded movement of yarn through the needle eye when the needle is withdrawn in an upward direction, the path being so shaped and dimensioned as to produce a needle deflection angle of not more than 13 degrees, said deflection angle being defined as an angle between the axis of a measuring rod having a diameter of exactly 0.3 times the maximum lengthwise extent of the needle eye and the longitudinal axis of the needle.

The applicants have discovered while testing their standard WRONZ needles that although these needles are a substantial improvement over carpet tufting needles used in the past there is room for a reduction in the number of yarn breakages during use of the WRONZ standard needles.

An object of the present invention is therefore to produce a needle for use on a carpet tufting, sewing, stitching and the like machine which reduces the number of yarn failures caused thereby whilst also exhibiting increased wear life.

SUMMARY OF THE INVENTION

According to the broadest aspect of the present invention there is provided a needle for tufting, sewing, stitching and the like machines, the needle including a shaped elongate blade having at one end thereof a shank and at the other end thereof a point adjacent to which is positioned a needle eye, the elongate blade having a shaped longitudinal input recess in one side of the blade above the eye, the input recess having a sloped floor region immediately above the eye which is in the same plane as any bias on the shank of the needle and wherein the angle of the floor relative to the sides of the needle eye is outside the range of 85°-95° degrees.

According to a second aspect of the present invention there is provided a needle for tufting, sewing, stitching and the like machines, the needle including a shaped elongate blade having at one end thereof a shank and at the other end thereof a point adjacent to which is positioned a needle eye, the elongate blade and the point having a shaped path formed therein above the needle eye and on the point, the path being defined as a longitudinal input recess located in one side of the blade above the eye and a cut-away portion on a side of a region of the point opposite said one side on which the longitudinal recess is located, the input recess having a sloped region immediately above the eye which is in the same plane as a bias of the shank of the needle, the path allowing substantially unimpeded movement of yarn through the needle eye when the needle is withdrawn in an upward direction, the path being so shaped and dimensioned as to produce a needle deflection angle of not more than 13° degrees, said deflection angle being defined as an angle between the axis of a measuring rod having a diameter of exactly 0.3 times the maximum lengthwise extent of the needle eye and the longitudinal axis of the needle.

The sloped region of the input groove or recess can have a sloped floor wherein the angle of the floor relative to the sides of the needle eye is outside the range of 85°-95° degrees.

Further aspects of the present invention should be considered in all its novel aspects will become apparent from the following description which is given by way of example only.

BRIEF DESCRIPTION OF THE DRAWINGS

An example of the present invention will now be described with reference to the accompanying drawings in which.

DESCRIPTION OF THE PREFERRED EMBODIMENT

Figure 1:
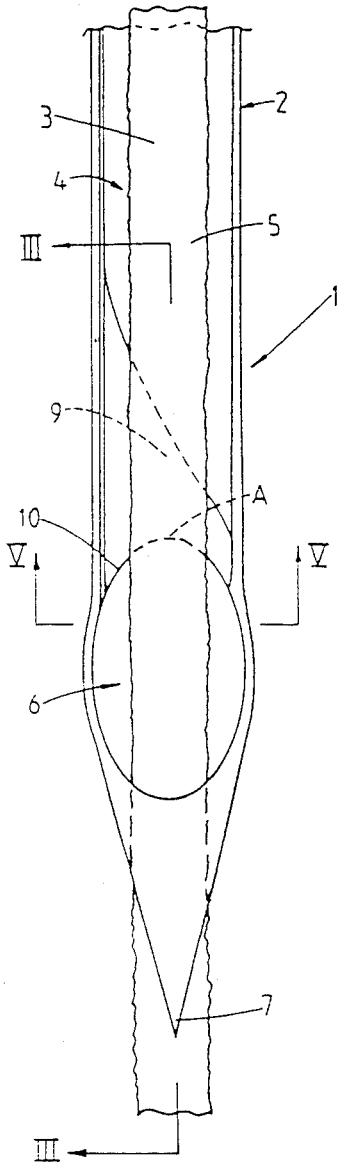
FIG. 1: is a front view of a construction of needle according to the present invention.
Figure 2:
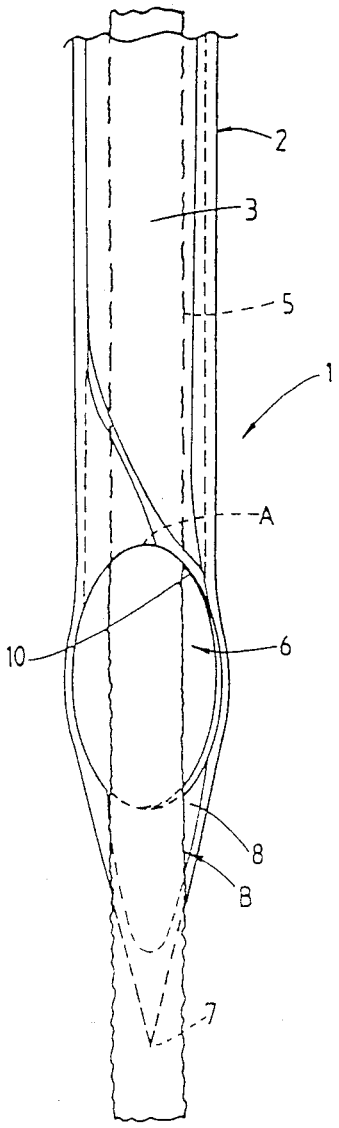
FIG. 2: is a rear view of the needle shown in FIG. 1.
Figure 3:
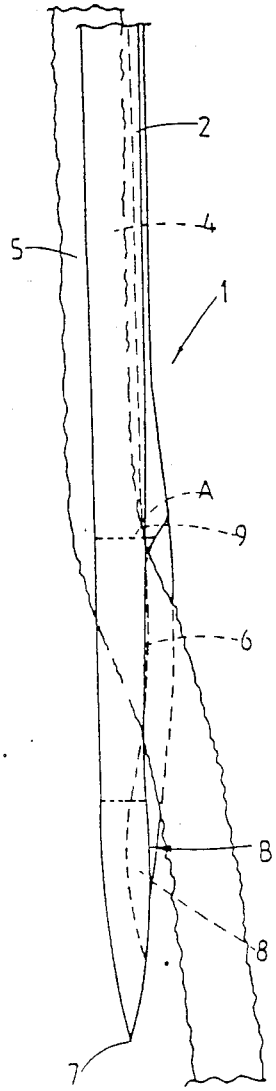
FIG. 3: is a side view of the needle shown in FIGS. 1 and 2.
Figure 4:
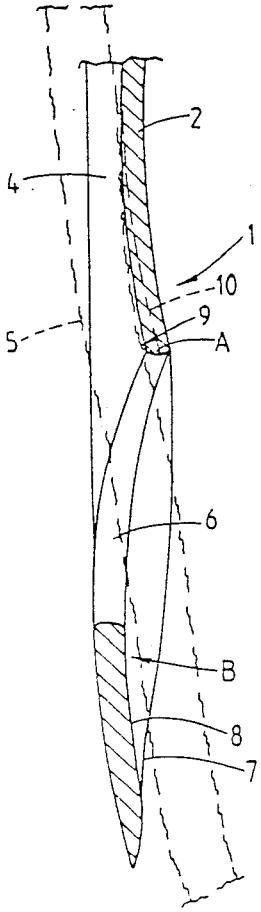
FIG. 4: is a section through the needle shown in FIGS. 1, 2 and 3 in the direction indicated by the arrows III—III in FIG. 1.

The example of needle described herein will be with reference to a needle designed for use on a carpet tufting, sewing, stitching and the like machine without imposing any limitation of the use of the needle to this type of machine.

The applicants effected a number of trials with modified WRONZ standard needles and discovered that a number of these needles exhibit improved performance in a carpet tufting machine in that the number of yarn failures of these modified needles is significantly improved over those of WRONZ standard needles.

The standard WRONZ needle described is the needle described and claimed in U.S. Pat. No. 4,233,917. In U.S. Pat. No. 4,233,917 is described a detailed description of the method of measuring the needle deflection angle of this type of needle to distinguish such a needle from needles used in the past. This method of distinguishing needles can also be used to test the modified needles.

The example of the present invention shown in the drawings is a modified WRONZ standard needle and it is to be appreciated that the invention also resides in modifying or manufacturing any tufting, sewing, stitching and the like needles to incorporate the invention. The needles having a shaped elongate blade with an input recess above the eye, the input recess having a sloped floor region which is in the same plane as a bias of the shank of the needle. The angle of the floor relative to the sides of the needle eye is outside the range of 85° to 95° degrees.

The needle shown in the drawings is generally indicated by arrow 1 and has a shank portion 2 (the upper end of the shank is not shown) adapted for attachment to a needle bar of a tufting, sewing, stitching and the like machine.

The shank 2 is connected to an elongate blade 3 in which a londitudinal input groove or recess is milled in one side above a needle eye 6. The input groove 4 forms a path for yarn 5 toward the needle eye 6.

The groove or recess 4 is milled so that it increases in depth toward a point A immediately above the needle eye 6.

A point region 7 of the needle 1 has a portion thereof opposite said one side milled during manufacture thus reducing the thickness in cross section of the point 7 in the region of arrow B. The region B which is on the opposite side of the blade 3 to the groove 4 can be a cutaway portion 8 as shown. The shape of the cutaway portion 8 should be such as to give a minimum of cross sectional thickness of the needle at point B providing adequate mechanical strength and stability is retained.

The needle as described above is a standard WRONZ needle which has a needle deflection angle of not more than 13° degrees when measured using the measuring guide described in U.S. Pat. No. 4,233,917.

The second aspect of the present invention requires a standard WRONZ needle, for example, with a biased tip as shown in the drawings to be modified. The groove 4 is deepened to the maximum extent possible in the region A. This effectively reduces to a minimum the deflection angle.

Figure 5:
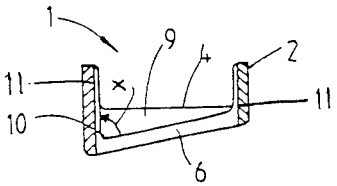
FIG. 5: is a section through the needle shown in FIG. 1 in the direction indicated by the arrows V—V.
Figure 6:
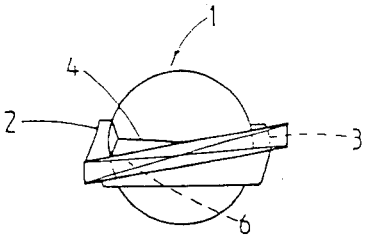
FIG. 6: is an end view of the needle shown in FIGS. 1 to 3.

The shape of the groove 4 in the region A immediately above the needle eye 6 is altered to be in sympathy with any bias on the needle and if included enlarged scarf features of the needle. In particular a bottom 9 of the groove 4 is sloped transversely so that the plane thereof is parallel to the plane of any bias on the needle. The deepening is on one side 10 of the groove 4 (see FIG. 5).

The angle x between the floor 9 of the input groove 4 and the sides 11 of the needle eye 6 is outside the range of 85°–95°.

The advantage of this construction is that a low joint failure rate is retained at the same time as maintaining adequate strength in the needle as the needle need only be milled a minimum amount.

Test results comparing, an existing needle, a standard WRONZ needle with a modified WRONZ needle have shown when running 5/32" Gauge 800TEX woollen spun yarn through a cut pile tufting machine indicate the following results:

Yarn failure per 1000 joints.

41 Modified WRONZ standard Eisbar needle 1249 BSW/WZ

61 Standard WRONZ needle Eisbar catalogue 1249 BSW/W2

222 Eisbar catalogue 1249 BSW

The invention therefore resides in a needle modified to have an angled floor to its input groove 4, immediately above the needle eye 6, relative to the sides of the needle eye with an angle therebetween outside the range of 85°–95° or a needle manufactured to have the features of a WRONZ standard needle with the above-mentioned modification included during manufacture.

Thus by this invention there is provided a needle for a tufting, sewing, stitching and the like machine which reduces the number of yarn failures caused thereby whilst also exhibiting increased wear life.

A particular example of the present invention has been described herein by way of example and it's envisaged that improvements and modifications thereto can take place without departing from the scope and spirit of the appended claims.

What I do claim and desire to obtain by Letters Patent of the United States of America is:

1. A needle for tufting, sewing, stitching and the like machines, the needle including a shaped elongate blade having at one end thereof a shank and at the other end thereof a point adjacent to which is positioned a needle eye, the elongate blade having a shaped longitudinal input recess in one side of the blade above the eye, the input recess having a sloped floor region immediately above the eye which is in the same plane as any bias on the shank of the needle and wherein the angle of the floor relative to the sides of the needle eye is outside the range of 85°–95° degrees.

2. A needle for tufting, sewing, stitching and the like machines, the needle including a shaped elongate blade having at one end thereof a shank and at the other end thereof a point adjacent to which is positioned a needle eye, the elongate blade and the point having a shaped path formed therein above the needle eye and on the point, the path being defined as a longitudinal input recess located in one side of the blade above the eye and a cutaway portion on a side of a region of the point opposite said one side on which the longitudinal recess is located, the input recess having a sloped region immediately above the eye which is in the same plane as a bias of the shank of the needle, the path allowing substantially unimpeded movement of yarn through the needle eye when the needle is withdrawn in an upward direction, the path being so shaped and dimensioned as to produce a needle deflection angle of not more than 13 degrees, the deflection angle being defined as an angle between the axis of a measuring rod having a diameter of exactly 0.3 times the maximum lengthwise extent of the needle eye and the longitudinal axis of the needle.

3. A needle as claimed in claim 2 wherein the sloped region of the input groove or recess has a sloped floor wherein the angle of the floor relative to the sides of the needle eye is outside the range of 85°–95° degrees.

4. A needle as claimed in claim 1 wherein the elongate blade and the point of the needle is twisted or biased.

5. A needle as claimed in claim 3 wherein the elongate blade and the point of the needle are twisted or biased.

6. A needle as claimed in claim 4 wherein the bottom of the eye at the top of the cut-away portion has a curved shape.

7. A needle as claimed in claim 5 wherein the elongate blade has a slight lump on the side thereof opposite to the cut-away portion of the point to allow the cut-away portion to be made deeper in the side of the point.

8. A needle as claimed in claim 5 wherein the needle adjacent the region of the eye is bulged to allow a wider eye to be formed therein.

9. A needle as claimed in claim 1 wherein the point thereof is off-centre.

* * * * *